United States Patent [19]

Soucy

[11] 4,155,860

[45] May 22, 1979

[54] LUBRICANT ADDITIVE COMPOSITION

[76] Inventor: Robert J. Soucy, 7700 Highway 2, Lot 35, Commerce City, Colo. 80022

[21] Appl. No.: 830,324

[22] Filed: Sep. 2, 1977

[51] Int. Cl.[2] ..... C10M 1/10; C10M 3/02; C10M 5/02; C10M 7/02

[52] U.S. Cl. ..... 252/26; 252/25

[58] Field of Search ..... 252/26, 25

[56] References Cited

U.S. PATENT DOCUMENTS

| | | | |
|---|---|---|---|
| 2,321,203 | 6/1943 | Henry et al. | 252/26 |
| 2,758,085 | 8/1956 | Oberright | 252/26 |
| 2,928,214 | 12/1975 | Tomobe et al. | 252/26 |
| 3,063,941 | 11/1962 | Wilson | 252/26 |
| 3,409,549 | 11/1968 | Freeman | 252/26 |
| 3,994,697 | 11/1976 | Burke | 252/26 |

*Primary Examiner*—Delbert E. Gantz
*Assistant Examiner*—Irving Vaughn
*Attorney, Agent, or Firm*—Ralph F. Crandell

[57] ABSTRACT

A lubricant additive composition for use with petroleum base lubricant media. The additive is formed of an admixture of about 1 to about 3 parts by weight copper metal flake or powder particles having a size of about 1 to about 2 microns, about 2 to about 4 parts by weight chromium metal flake or powder particles having a size of about 1 to about 2 microns, about 1 to about 3 parts by weight zinc metal flake or powder particles having a size of about 1 to about 2 microns and about 2 to about 4 parts by weight molybdenum disulfide particles having a size of about 1 to about 2 microns. The additive is admixed with a petroleum base lubricant in the weight ratio of from about 0.001 to about 0.015 parts by weight additive per part by weight lubricant medium. The lubricant and admixed additive, when utilized in an internal combustion engine, increases the engine compression and reduces noxious emissions.

6 Claims, No Drawings

LUBRICANT ADDITIVE COMPOSITION

FIELD OF THE INVENTION

The present invention relates to a lubricant additive composition for use with a petroleum base lubricating medium, and more particularly to a lubricant additive composition finding particular but not necessarily exclusive utility as an additive for motor oil and like petroleum products.

OBJECTS OF THE INVENTION

It is the principal object of the present invention to provide an improved additive composition for use with a petroleum base lubricating medium.

Another object of the present invention is to provide an improved lubricant additive composition which when added to a lubricant such as the motor oil utilized in an internal combustion engine increases the life of the engine, increases gas mileage and reduces pollutant products of combustion.

More specifically, it is an object of the present invention to provide a lubricant additive composition which when utilized in the crank case oil of an internal combustion engine increases the engine compression and thereby increases the engine life, gas mileage and reduces air pollutants produced by the engine.

A further object of the present invention is to provide an improved lubricant additive composition of the foregoing character which is useful in connection with a wide variety of petroleum based lubricant products including but not limited to motor oil, greases and the like.

Other objects and advantages of the invention will become appparent as the following description proceeds.

SUMMARY OF THE INVENTION

In accordance with the foregoing objects, the present invention is embodied in a lubricant additive composition for use with petroleum base lubricating materials. The composition is formed of particles of copper metal, chromium metal, zinc metal, and molybdenum disulfide. The particles are finely divided powders or flakes of about 1 to 2 microns in size. The additive composition is formed by admixing 1 to 3 parts by weight copper metal flake or powder, 2 to 4 parts by weight of chromium metal flake or powder, 1 to 3 parts by weight of zinc metal flake or powder and 2 to 4 parts by weight molybdenum disulfide. A lubricating composition is then initially formed by admixing from about 0.02 to about 0.06 parts by weight of the combined additive ingredients per part of a suitable oil, that is about one-half to two ounces of the additive mixture to a quart of oil (30 ounces). This master mixture is then added to the oil in an engine crank case to produce about 5 quarts of oil containing from about ½ ounce to about 2 ounces of the additive. The additive composition is added to the lubricant in the overall ratio of about 0.001 to about 0.015 parts by weight of the solid particulate additive composition to each part by weight oil. Preferably, from about 0.0019 to about 0.0038 parts by weight of the additive are added to each part by weight of oil. In other words, approximately 8 to 16 grams of the additive are added to five quarts of oil. The additive may of course be added to other lubricants such as greases in approximately the same ratio. When added to motor oils, the additive has been found to substantially increase engine compression and reduce undesirable emission pollutants.

DESCRIPTION OF THE PREFERRED EMBODIMENT

The present invention is embodied in a lubricant additive composition for a petroleum base lubricant medium. The composition is formed of a mixture of copper metal flake or powder particles, chromium metal flake or powder particles, zinc metal flake or powder particles, and molybdenum disulfide particles. All of the particles are finely divided, being micron size, generally from about 1 to 2 microns. These materials are readily available, one source of supply being Micron Metals, Incorporated, 7186 W. Gates Avenue, Salt Lake City, Utah.

The additive composition is made up of from about 1 to about 3 parts by weight copper metal particles, from about 2 to about 4 parts by weight chromium metal particles, from about 1 to about 3 parts by weight zinc metal particles and from about 2 to about 4 parts by weight molybdenum desulfide particles. A composition mixed in the foregoing ratios is then added to the desired lubricant in the ratio of about 0.001 to about 0.015 parts by weight additive composition to each part by weight oil or other petroleum base medium. More specifically, it has been found that the preferred range is from about 0.0019 to about 0.0038 parts by weight additive to each part by weight petroleum base lubricant medium. Various petroleum base lubricant media include conventional motor oil, transmission oils, differential oils and greases, and other oils and greases finding particular but not necessarily exclusvie utility in the lubrication of automotive vehicles.

In preparing the additive for addition to a selected petroleum medium, it is preferred to weigh the additive powders into an appropriate container and add a sufficient amount of oil or other petroleum liquid to make a concentrate or slurry. To this end, from about 0.02 to about 0.06 parts by weight of the desired additive mixture are admixed in a part by weight of oil. Illustratively, between 0.5 and 2 ounces of the particulate mixture is added to 30 ounces, or a liquid quart, of oil. The mixture is stirred to thoroughly and uniformly suspend the particles in the oil, and the oil is then added, for example, to an automobile crank case. A similar master batch or concentrate could be prepared for example when the additive is to be utilized in a grease or other heavy viscous petroleum lubricating medium.

The following examples will illustrate the present invention. The particulate materials utilized in each example are as described above.

EXAMPLE I

An additive composition composed of 2 grams copper metal flake, 4 grams chromium metal flake, 4 grams zinc metal flake, and 6 grams molybdenum disulfide, were added to five quarts of oil in the engine crank case of a Honda 750 four cylinder internal combustion engine. Prior to addition of the additive, the engine cylinders showed compression figures of 75, 95, 87 and 91. Following the addition of the composition, the cylinder compression figures were 110, 114, 118 and 120 respectively. Engine noise was reduced, engine temperature was lowered and decreased oil use was noted.

EXAMPLE II

An additive composition composed of 2 grams copper metal flake, 3 grams chromium metal flake, 1 gram zinc metal flake, and 2 grams molybdenum disulfide were added to five quarts of oil in the internal combustion engine of a 1968 Duster. An increase in power, and gas mileage was noted. The additive stopped a leak in the rear main seal, quieted the valve lifters and increased cylinder compression.

EXAMPLE III

An additive composition composed of 2 grams copper metal flake, 4 grams chromium metal flake, 4 grams zinc metal flake and 6 grams molybdenum disulfide were added to five quarts of oil in the crank case of a six cylinder Dodge truck engine. Before addition of the additive to the crank case, the engine showed cylinder compressions of 80, 75, 45, 75, 55 and 55. Following addition of the additive, the engine cylinder compressions were increased to 100, 100, 60, 95, 75 and 65 respectively. EPA emission tests showed a substantial reduction in percent carbon monoxide emissions, parts per million hydrocarbons and parts per million nitrogen oxides.

EXAMPLE IV

An additive composition prepared from materials described above in the amounts of 2 grams copper metal flake, 4 grams chromium metal flake, 4 grams zinc metal flake and 6 grams molybdenum disulfide was added to five quarts of oil in the internal combustion engine of a Datsun 70 automobile. Prior to addition of the composition, the engine evidenced cylinder compressions of 85, 120, 120 and 105. After addition, the engine cylinder compressions were 125, 125, 125 and 123 respectively. EPA emission tests on the vehicle showed an improvement in the emission of pollutants as a result of the use of the additive.

EXAMPLE V

An additive composed of 2 grams copper metal flake, 2 grams chromium metal flake, 2 grams zinc metal flake and 3 grams molybdenum disulfide was added to five quarts of oil in an eight cylinder internal combustion engine in a Chrysler 1966 station wagen. Prior to the addition of the additive, the engine showed cylinder compressions of 120, 120, 120, 120, 115, 120, 115, 114, while after the addition of the additive, the engine compressions were 125, 125, 127, 126, 122, 124, 149, 148 respectively. EPA emissions test results showed a substantial reduction in percent carbon monoxide, parts per million hydrocarbons and parts per million nitrogen oxides as a result of the addition of the additive.

EXAMPLE VI

An additive embodying the present invention and composed of 1 gram copper metal flake, 1 gram chromium metal flake, 1 gram zinc metal flake and 1 gram molybdenum disulfide was added to five quarts of oil in an eight cylinder internal combustion engine in a 1973 GMC truck. Prior to the addition, the engine evidenced compressions of 125, 140, 118, 125, 123, 116, 125 and 126. After the addition of the additive, the engine showed compressions of 130, 150, 150, 128, 146, 144, 149 and 150 respectively.

While certain illustrative embodiments of the present invention have been described above in considerable detail, it should be understood that there is no intention to limit the invention to the specific forms and embodiment disclosed. On the contrary, the intention is to cover all modifications, alternative compositions, equivalents and uses falling within the spirit and scope of the invention as expressed in the appended claims.

I claim:

1. A lubricant additive composition for admixture with a petroleum based lubricant medium, consisting essentially of from about 1 to about 3 parts by weight finely divided copper metal particles , from about 2 to about 4 parts by weight finely divided chromium metal particles, from about 1 to about 3 parts by weight finely divided zinc metal particles, and from about 2 to about 4 parts by weight finely divided molybdenum disulfide particles.

2. A lubricant composition comprising the admixture of a petroleum based lubricating medium, and a lubricant additive as defined in claim 1, in the weight ratio of 0.001 to 0.015 parts by weight additive per part by weight petroleum based lubricating medium.

3. A lubricant additive composition as defined in claim 1 in admixture with internal combustion engine motor oil in the ratio of about 0.0019 to about 0.0038 parts by weight additive per part by weight motor oil.

4. A lubricant additive composition as defined in claim 1 wherein said copper, chromium, zinc and molybdenum disulfide particles are in equal amounts by weight.

5. A lubricant additive composition as defined in claim 1 wherein said copper, chromium, zinc and molybdenum disulfide particles are in the weight ratio of 2:4:4:6 parts respectively.

6. A lubricant composition as defined in claim 1 wherein said copper, chromium, zinc and molybdenum disulfide particles are in the ratio of 2:3:1:2 parts by weight respectively.

* * * * *